US005553478A

United States Patent [19]

Di Troia

[11] Patent Number: 5,553,478

[45] Date of Patent: Sep. 10, 1996

[54] HAND-HELD COMPRESSION TOOL

[75] Inventor: Gary W. Di Troia, Nashua, N.H.

[73] Assignee: Burndy Corporation, Norwalk, Conn.

[21] Appl. No.: 224,825

[22] Filed: Apr. 8, 1994

[51] Int. Cl.[6] ..... B21J 9/14; B21J 9/18

[52] U.S. Cl. ..... 72/453.15; 72/1

[58] Field of Search ..... 72/453.15, 453.16, 72/449, 407, 1

[56] References Cited

U.S. PATENT DOCUMENTS

| | | | |
|---|---|---|---|
| 2,158,855 | 5/1939 | Eby et al. | 140/113 |
| 2,180,979 | 11/1939 | Eby et al. | 140/113 |
| 2,343,595 | 3/1944 | Van Sittert | 78/48 |
| 3,397,567 | 8/1968 | Klingler et al. | 72/449 |
| 4,084,460 | 4/1978 | Garofalo | 81/10 |
| 4,475,374 | 10/1984 | Sakai et al. | 72/452 |
| 4,774,762 | 10/1988 | Gobeil | 29/861 |
| 4,914,941 | 4/1990 | Ijiri et al. | 72/449 |
| 4,932,237 | 6/1990 | Hatfield | 72/452 |
| 4,956,992 | 9/1990 | Undin | 72/451 |
| 5,111,681 | 5/1992 | Yasui et al. | 72/453.03 |
| 5,113,679 | 5/1992 | Ferraro et al. | 72/21 |
| 5,152,162 | 10/1992 | Ferraro et al. | 72/20 |
| 5,195,042 | 3/1993 | Ferraro et al. | 364/468 |
| 5,195,354 | 3/1993 | Yasui et al. | 72/453.03 |
| 5,272,811 | 12/1993 | Armand | 30/228 |
| 5,282,378 | 2/1994 | Kimura | 72/453.15 |
| 5,301,530 | 4/1994 | Beelen et al. | 72/449 |

OTHER PUBLICATIONS

Advertisement, "ROBO*CRIMP", CEE News, Oct. 1989, 1 page.

Advertisement, "ROBO*CRIMP Model REC 58", T&D Construction Tools, 3 pages, 1993.

*Primary Examiner*—David Jones

*Attorney, Agent, or Firm*—Perman & Green

[57] ABSTRACT

A crimping tool for crimping electrical connectors. The tool has a compression head, a hydraulic pump, an electric motor, a removable rechargeable battery, and a control system. The control system has a printed circuit board that monitors voltage of the battery, a trigger, and a hydraulic system pressure sensor. The tool is prevented from starting a crimp operation if the circuitry on the printed circuit board senses a predetermined inadequate low voltage level of the battery that could otherwise prevent a good crimp from being obtained. After a good crimp is obtained, the circuitry disables operation of the motor for a predetermined amount of time.

20 Claims, 4 Drawing Sheets

HAND-HELD COMPRESSION TOOL

BACKGROUND OF THE INVENTION

1. Field of the Invention

The present invention relates to a tool for compressing articles and, more particularly, to a tool for crimping electrical connectors.

2. Prior Art

U.S. Pat. Nos. 5,113,679; 5,152,162; and 5,195,042 disclose a hydraulic compression tool with an electronic controller, batteries, signal lights, a hydraulic system pressure sensor, and a system for deactivating pumping effect of a pump when a predetermined hydraulic system pressure is reached. Huskie Tools Inc. of Glendale Heights, Ill. sells a portable, hand-held automatic cable crimper sold under the trademark ROBO*CRIMP that uses replaceable, rechargeable battery cartridges. An LED battery power level indicator flashes when five compression cycles remain. Other relevant art includes the following U.S. Pat. Nos.: 2,998,590; 4,300,282; 4,597,158; 4,914,941; 4,932,237; and 4,956,992.

SUMMARY OF THE INVENTION

In accordance with one embodiment of the present invention, a compression apparatus is provided comprising a compression head, a hydraulic pump, an electric motor, a power source, a sensor, and means for disabling operation of the motor. The hydraulic pump is operably connected to the compression head. The electric motor is operably connected to the hydraulic pump. The power source is electrically connectable to the electric motor to drive the motor. The sensor is provided for sensing voltage of the power source. The means for disabling is connected to the sensor and is adapted to disable operation of the motor when the sensor senses a predetermined inadequate low voltage level of the power source.

In accordance with another embodiment of the present invention a hand held crimping tool is provided comprising an electric motor, a battery for powering the electric motor, and means for disabling crimping ability of the tool. The means for disabling can disable the tool based upon the battery having a predetermined inadequate low voltage level for obtaining a good crimp.

In accordance with another embodiment of the present invention a hand held crimping tool is provided comprising a compression head, a drive system, and a control system. The drive system is operable connected to the compression head. The drive system has a hydraulic pressure system with a pump, an electric motor connected to the pump, and a battery. The control system is operably connected to the motor. The control system has a user actuated activation trigger, a hydraulic system pressure switch, and means for disabling operation of the motor. The means for disabling is adapted to disable the motor when the pressure switch is activated by a predetermined hydraulic pressure in the hydraulic pressure system.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
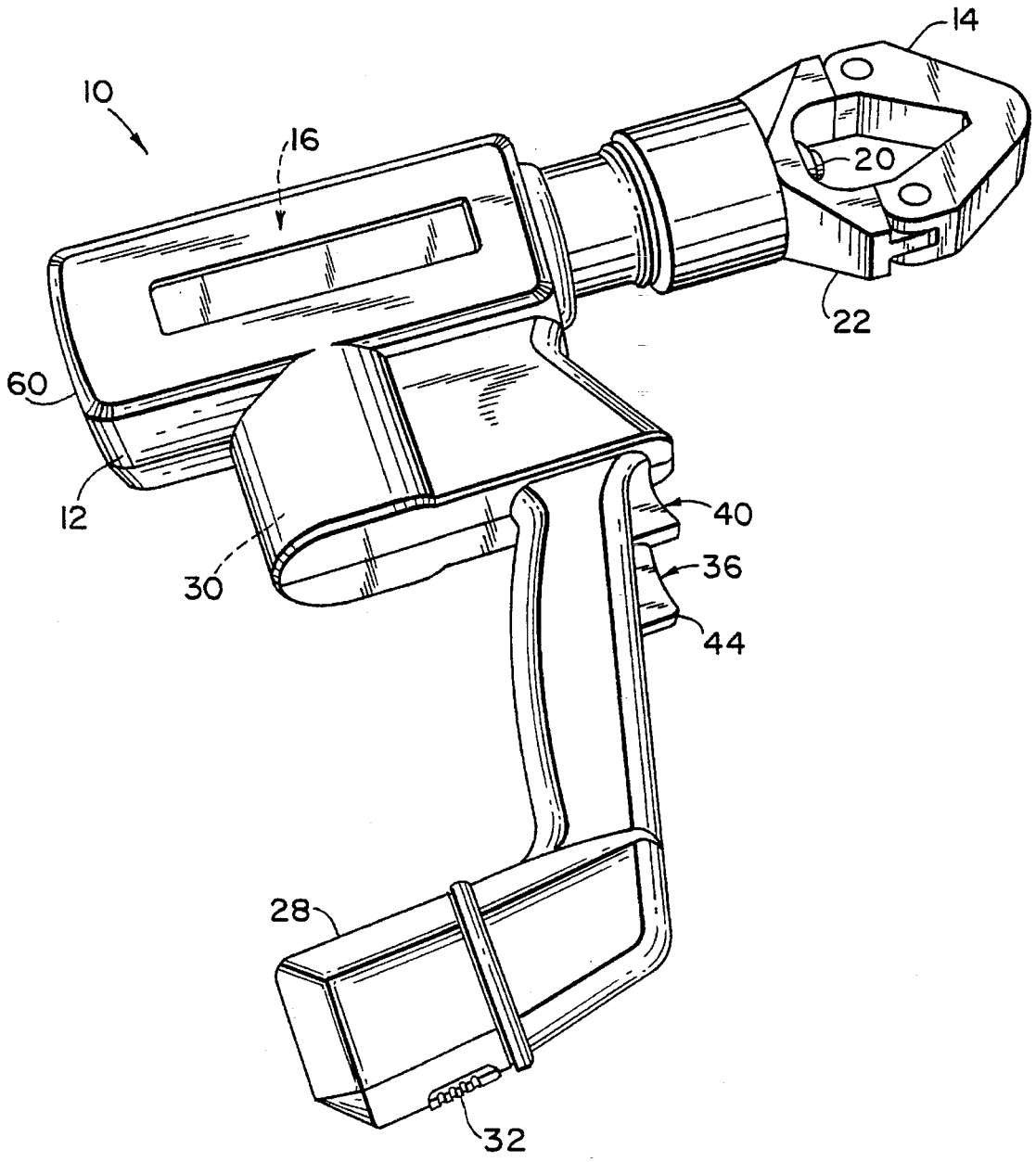
FIG. 1 is a perspective view of a crimping tool incorporating features of the present invention.

Referring to FIG. 1 there is shown a perspective view of a tool 10 for crimping an electrical connector onto a wire. Although features of the present invention will be described with reference to the single embodiment shown in the drawings, it should be understood that features of the present invention can be embodied in various different types of alternate embodiments. In addition, any suitable size, shape, or type of materials or elements can be used.

Figure 2:
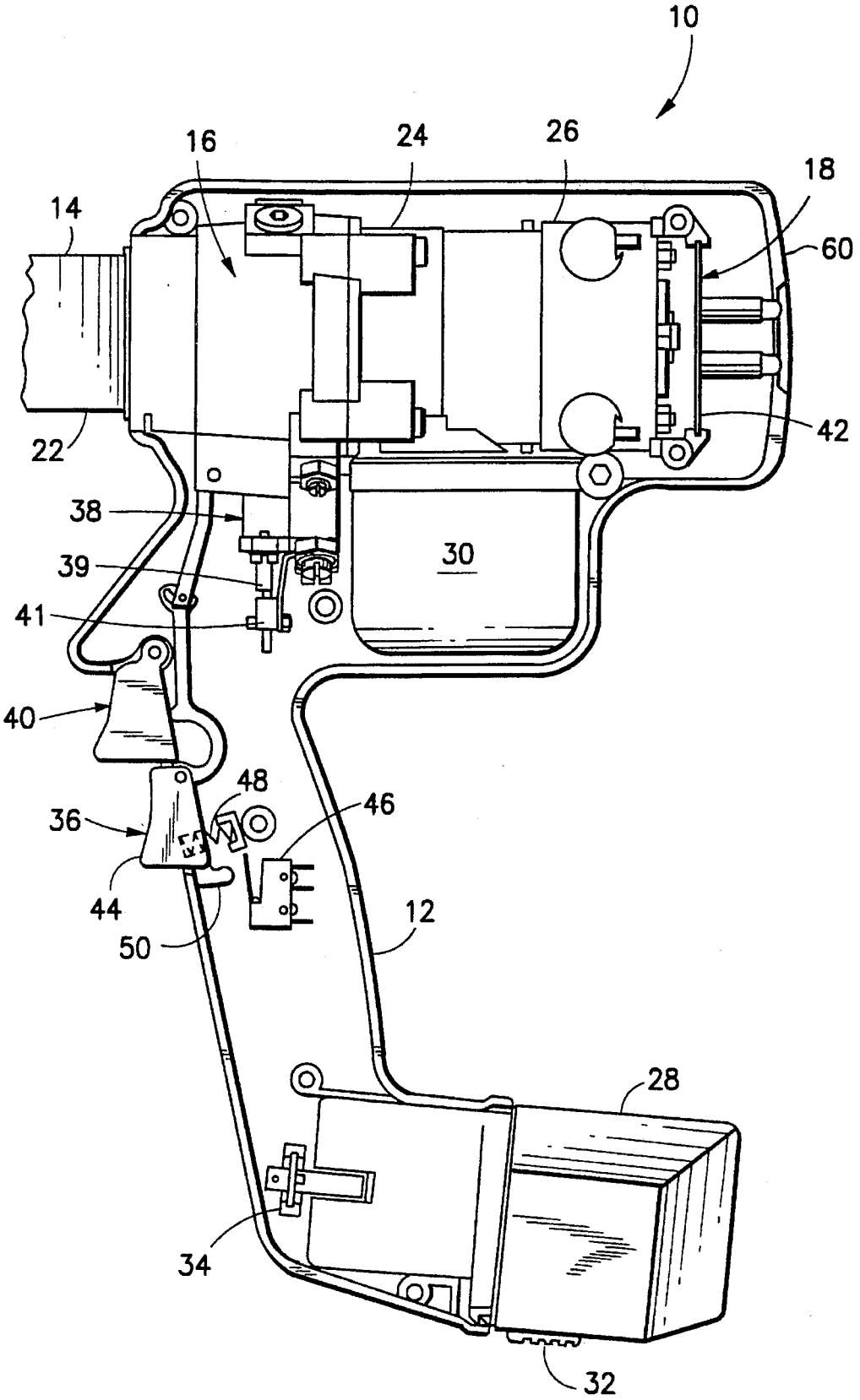
FIG. 2 is a schematic sectional view of the body of the tool shown in FIG. 1.

Referring also to FIG. 2, the tool 10 generally comprises a housing 12, a compression head 14, a drive system 16, and a control system 18. The compression head 14 is a well known part of crimping tools and includes a spring loaded ram 20 and a frame 22 that forms an anvil section for the ram. However, any suitable compression head could be provided. Removable crimping dies could also be provided.

The drive system 16 generally comprises a hydraulic pressure system with a pump 24, an electric motor 26, and a battery 28. The use of a hydraulic pressure system to move a ram is generally known in the art as seen by U.S. Pat. No. 5,113,679 which is hereby incorporated by reference in its entirety. Instead of the manually actuated pump disclosed in U.S. Pat. No. 5,113,679, the tool 10 uses the motor driven pump 24. In a preferred embodiment the pump 24 is a five radial piston, self-regulating variable capacity, direct drive micro-hydraulic pump manufactured by Hydro Rene Leduc of France. However, other types of pumps could be used. The hydraulic system includes a pressurized hydraulic reservoir 30 that the pump 24 can receive hydraulic fluid from and, which can receive hydraulic fluid from the compression head 14 as the ram 20 is being retracted. In the embodiment shown, the motor 26 is a high performance rare earth element permanent magnet motor manufactured by G.E.C.-Alsthom. However, in alternate embodiments, other types of motors could be used. The motor 26 is directly connected to the pump 24 without a gear transmission. The battery 28, in the embodiment shown, is a 12 volt removable rechargeable Nickel-Cadmium battery made from ten sub-C cells yielding 1.7 amp-hours of charge. However, in alternate embodiments, other types of batteries or power sources could be used. The battery 28 has a latch 32 for snap latching and removing the battery from connection with the housing 12. Located inside the housing 12 is a battery terminal 34 for making electrical connection with a connected battery.

Figure 3:
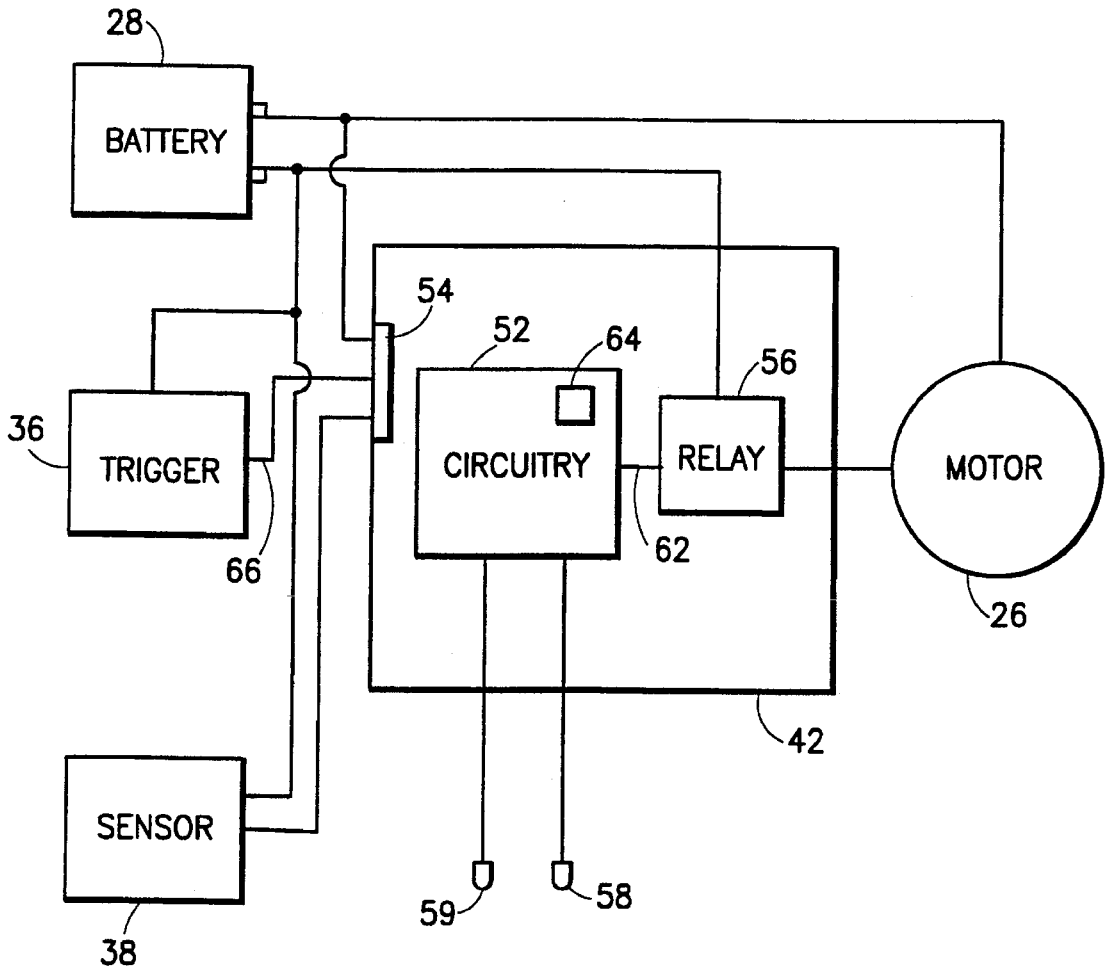
FIG. 3 is a schematic diagram of the electrical system used in the tool shown in FIG. 2.

The control system 18 generally comprises an activation trigger 36, a hydraulic system pressure switch or sensor 38, a release trigger 40, and a printed circuit board 42. Referring also to FIG. 3, a schematic diagram of the electrical system is shown. The activation trigger 36 generally comprises a trigger member 44 and a microswitch 46. The trigger member 44 is pivotably mounted to the housing 12. A spring 48 is used to bias the trigger member 44 in a forward position. The trigger member 44 has a section 50 adapted to activate the microswitch 46 when the trigger member 44 is depressed by a user. The pressure sensor 38 is similar to the pressure sensor described in U.S. Pat. No. 5,113,679 with a spring loaded plunger 39 and a microswitch 41. When the hydraulic system pressure reaches a predetermined pressure, such as about 12,000 psi, the plunger 39 is moved by the hydraulic fluid. The spring (not shown) is compressed and the microswitch 41 is activated. The trigger microswitch 46 and sensor 38 are connected in parallel between the battery 28 and circuitry 52 on the printed circuit board 42. The printed circuit board 42 generally comprises the circuitry 52, an electrical connector 54, a relay 56, and two LEDs 58,59. The two LEDs 58,59 are connected to the circuitry 52. The first LED 58 is an orange/red LED. The second LED 59 is a green LED. The circuitry 52 can selectively light the two LEDs. The LEDs project out apertures at a rear end or face 60 of the housing 12. The relay 56, in the embodiment shown, is mounted on the board 42. The relay 56 is preferably a coil relay. A control conductor 62 from the circuitry 52 is adapted to energize the coil of the relay to close the relay. The relay 56 is operably connected between the motor 26 and battery 28 to function as a switch for turning the motor 26 ON and OFF. The connector 54 provides connection of the battery 28, trigger 36, and sensor 38 to the circuitry 52 on the board 42. The circuitry 52 is suitably configured to monitor or sense the voltage of the battery 28, to sense the activation of trigger 36 and sensor 38, and control energization of the coil of the relay 56 based upon the sensed voltage of the battery 28 and the status of the trigger 36 and sensor 38. The circuitry also includes a time delay section 64. This time delay section 64 is configured to prevent energization of the coil of the relay 56 for a predetermined length of delay time, such as about 4.5 seconds, after the sensor 38 has been activated.

Figure 4:
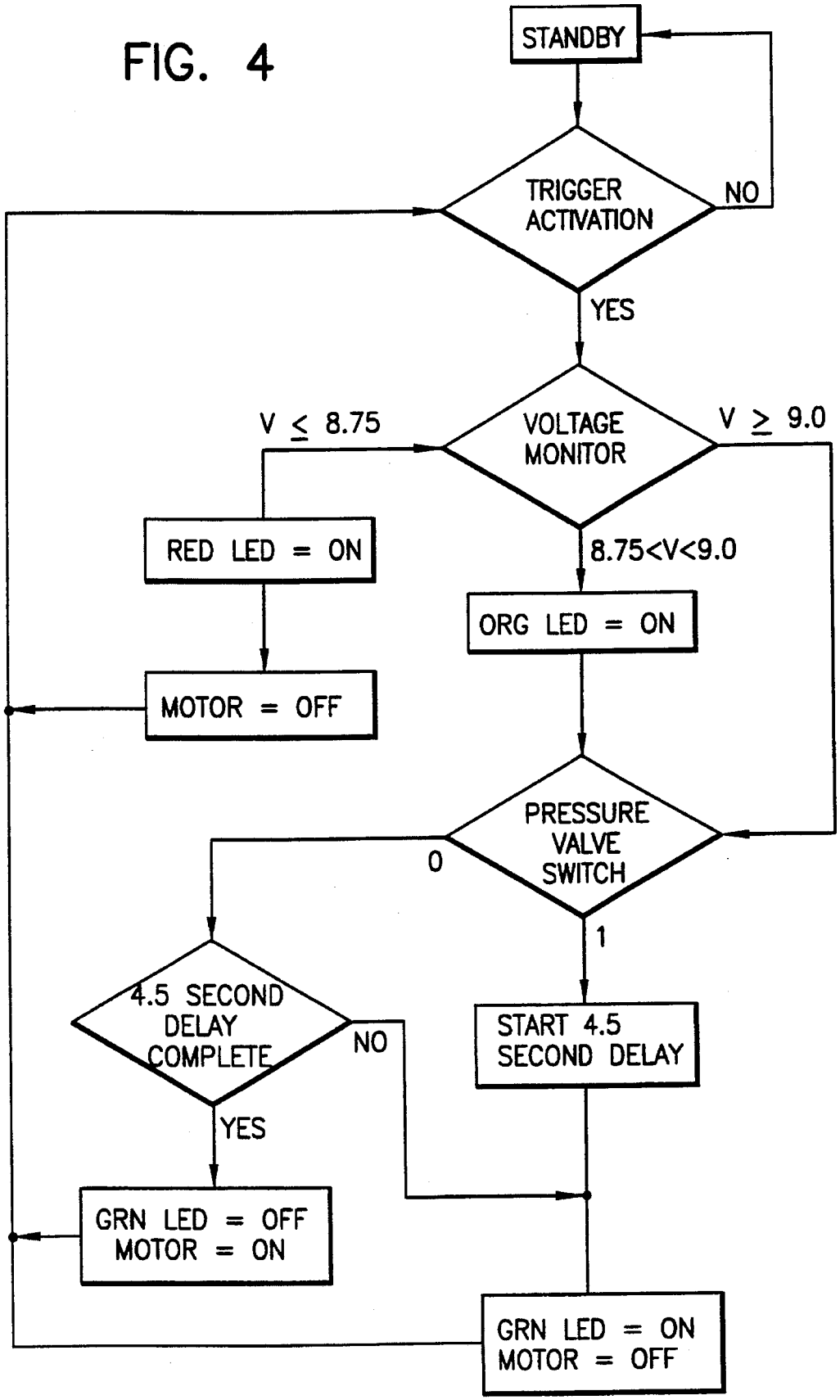
FIG. 4 is a logic flow diagram for the control system used in the tool shown in FIG. 2.

Referring now also to FIG. 4, operation of the tool will now be described. The tool, when not being used, is in a standby mode. If the trigger 36 is activated, the circuitry 52 senses this by means of a signal along line 66 and then checks or monitors the voltage of the battery 28. Based upon the sensed voltage of the battery 28, the circuitry 52 will perform one of three possible functions. If the voltage is less than or equal to a predetermined inadequate low voltage level, such as about 8.75 volts, the circuitry 52 will turn the first LED 58 ON to the color red and, keep the motor 26 OFF. As used herein, the term "predetermined inadequate low voltage level" is intended to mean a battery voltage level that can still drive the motor, but is insufficient to allow a good crimp to be made. In other words, the power in the battery is insufficient to drive the motor to obtain compression at the compression head to the predetermined pressure of about 12,000 psi. If the tool did operate at this predetermined inadequate low voltage level, there is a good likelihood that a bad crimp or insufficient crimp would occur. The present invention, prevents the tool from even starting a crimp cycle if there is a good likelihood that a good crimp cannot be made with the available power in the battery 28. In addition, the red light from the first LED 58 clearly indicates or signals the user that the reason why the tool is not operating is because of the low voltage level in the battery 28.

If the sensed battery voltage is above the predetermined inadequate low voltage level, but less than a preferred minimum voltage level, such as about 9.0 volts, the circuitry 52 will turn the first LED 58 ON to the color orange, but otherwise proceed with its normal operation. As used herein, the term "preferred minimum voltage level" is intended to mean a battery voltage level near the predetermined inadequate low voltage level. Thus, the first LED 58 being lit orange functions as a warning to the user that the battery voltage is approaching the predetermined inadequate low voltage level, but is not that low yet. In a preferred embodiment, the first LED 58 will first be lit orange when about five crimp cycles of the tool are left before the predetermined inadequate low voltage level will be reached.

If the sensed battery voltage is greater than or equal to the preferred minimum voltage level, the circuitry 52 senses whether or not the pressure sensor 38 has been activated by a maximum hydraulic system pressure. If the sensor 38 has been activated, it sends a pulse to the circuitry 52 and time delay section 64 to deactivate the coil in the relay 56 and start the time delay (if not presently active) before the coil can be reenergized. In this fashion, the relay 56 breaks the circuit between the battery 28 and motor 26. This automatically stops the motor 26 which stops the pump 24 even if the user is still depressing the trigger member 44. The circuitry 52 also turns the second LED 59 ON to the color green to thereby signal the user of the completion of a good crimp. If the pressure sensor 38 has not been activated, but the delay time is not complete, the motor is still kept OFF by the relay 56. This could occur such as when the pressure in the hydraulic system was released slightly, but before the user had prepared the tool for a new crimp cycle. If the delay time is complete, the second LED is turned OFF and the relay 56 can be activated again to turn the motor 26 ON again.

The control system described above has several features. It monitors or signals completion of the crimp cycle (by signaling that the maximum hydraulic system pressure has been reached) and automatically turns the motor OFF to conserve battery energy. Thus, more crimping operations will be able to be performed from a single battery charge due to energy conservation. The orange lighting of the first LED warns the user that only a certain number of crimping operations can be performed before the tool will stop operating. The control system monitors battery power and disables the motor if battery voltage is too low to produce a likely good crimp. Thus, bad crimps are prevented. In addition, because the control system prevents the battery from starting to run the motor when the voltage of the battery is reduced to the predetermined inadequate low voltage level, the battery is prevented from being totally drained. Therefore, the battery can be recharged quicker and have a longer total work life. The control system also signals the end of a crimp completion by turning ON the green LED.

In an alternate embodiment, the predetermined inadequate low voltage level could be less than or more than 8.75 volts and, the preferred minimum voltage level could be more or less than 9.0 volts. A different type of hydraulic system sensor could be used. A different type of relay could be used. Other types of circuitry could also be used. Obviously, many different types of alternate embodiments could be devised from the above described features of the present invention. Features of the present invention could also be used in compression apparatus other than a connector crimping tool.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A compression apparatus comprising:

a compression head;

a hydraulic pump operably connected to the compression head;

an electric motor operably connected to the hydraulic pump;

a power source electrically connectable to the electric motor to drive the motor;

a sensor connected to the power source for sensing voltage of the power source; and means for disabling operation of the motor, the means for disabling being connected to the sensor to disable operation of the motor when the sensor senses a predetermined inadequate low voltage level of the power source.

2. An apparatus as in claim 1 wherein the electric motor is directly operably connected to the pump.

3. An apparatus as in claim 1 wherein the power source is a removable rechargeable battery.

4. An apparatus as in claim 1 further comprising a printed circuit board having the sensor integrated therein.

5. An apparatus as in claim 4 further comprising a housing and wherein the printed circuit board includes two LEDs that extend to a rear face of the housing.

6. An apparatus as in claim 4 wherein the printed circuit board has the means for disabling operation of the motor integrated therein.

7. An apparatus as in claim 6 wherein the means for disabling operation of the motor includes a switch between the power source and the motor that is retained open by circuitry on the printed circuit board for preventing electricity from reaching the motor.

8. An apparatus as in claim 7 wherein the switch is a coil relay.

9. A hand-held crimping tool comprising:

an electric drive motor;

a battery for powering the electric motor; and means for disabling crimping ability of the tool connected between the battery and the electric drive motor by interrupting supply of power to the electric drive motor based upon the battery having a predetermined inadequate low voltage level.

10. A tool as in claim 9 further comprising an activation trigger and wherein the means for disabling comprises a switch and a sensor, the switch being located between the battery and the motor that is only closed when a user actuates the activation trigger and when the sensor senses that the battery has a voltage greater than the predetermined inadequate low voltage level.

11. A tool as in claim 10 wherein the switch and sensor are integrated on a single printed circuit board.

12. A tool as in claim 11 wherein the switch is a coil relay wherein a coil of the relay is energized by circuitry on the printed circuit board only when the trigger is actuated and the sensor senses that the battery has a voltage greater than the predetermined inadequate low voltage level at a start of a cycle of the tool.

13. A tool as in claim 9 further comprising a hydraulic pressure system and means for deactivating crimping ability of the tool when the hydraulic pressure system of the tool reaches a predetermined hydraulic system pressure.

14. A tool as in claim 13 further comprising a printed circuit board and a switch, wherein the means for deactivating crimping ability of the tool includes a pressure sensor electrically connected to the printed circuit board, the switch being between the battery and motor which is opened when the sensor senses the predetermined hydraulic system pressure.

15. A tool as in claim 14 wherein the printed circuit board includes circuitry for providing a predetermined delay in time before crimping ability of the tool can be reactivated after the sensor senses the predetermined hydraulic system pressure.

16. A hand-held crimping tool comprising:

a compression head;

a drive system operably connected to the compression head, the drive system having a hydraulic pressure system with a pump, an electric motor connected to the pump, and a battery; and a control system operably connected to the motor, the control system having a user actuated activation trigger, a hydraulic system pressure switch, and means for disabling operation of the motor when the pressure switch is activated by a predetermined hydraulic pressure in the hydraulic pressure system.

17. A tool as in claim 16 wherein the control system has a printed circuit board with a relay switch between the battery and the motor.

18. A tool as in claim 17 wherein the trigger and pressure switch are connected in parallel between the battery and the printed circuit board.

19. A tool as in claim 17 further comprising a housing and wherein the printed circuit board includes two LEDs that extend out a rear face of the housing.

20. A tool as in claim 16 further comprising a housing and wherein the trigger includes a microswitch and a trigger member, the trigger member being pivotably mounted to the housing to actuate the microswitch when the trigger member is depressed.

* * * * *